US010046215B2

(12) United States Patent
Eastman

(10) Patent No.: US 10,046,215 B2
(45) Date of Patent: Aug. 14, 2018

(54) GRIP DEVICE AND METHOD FOR IMPROVING GRIP AND ALIGNING HANDS ON SPORTS EQUIPMENT

(71) Applicant: Jeffrey Eastman, Gilbert, AZ (US)

(72) Inventor: Jeffrey Eastman, Gilbert, AZ (US)

( * ) Notice: Subject to any disclaimer, the term of this patent is extended or adjusted under 35 U.S.C. 154(b) by 0 days.

(21) Appl. No.: 15/434,803

(22) Filed: Feb. 16, 2017

(65) Prior Publication Data

US 2017/0239541 A1 Aug. 24, 2017

Related U.S. Application Data

(60) Provisional application No. 62/298,898, filed on Feb. 23, 2016.

(51) Int. Cl.

| | |
|---|---|
| ***A63B 59/00*** | (2015.01) |
| ***A63B 69/36*** | (2006.01) |
| ***A63B 59/58*** | (2015.01) |
| ***A63B 60/06*** | (2015.01) |
| ***A63B 60/08*** | (2015.01) |
| ***A63B 60/10*** | (2015.01) |
| ***A63B 60/30*** | (2015.01) |

(52) U.S. Cl.

CPC ..... *A63B 59/58* (2015.10); *A63B 60/06* (2015.10); *A63B 60/08* (2015.10); *A63B 60/10* (2015.10); *A63B 60/30* (2015.10)

(58) Field of Classification Search

USPC ..... 473/201, 203, 204, 206, 219, 226, 300, 473/409

See application file for complete search history.

(56) References Cited

U.S. PATENT DOCUMENTS

| | | | | | |
|---|---|---|---|---|---|
| 1,075,054 | A | * | 10/1913 | Morley | A63B 53/14 43/23 |
| 3,104,876 | A | * | 9/1963 | Salsinger | A63B 59/50 473/568 |
| 3,860,243 | A | * | 1/1975 | Prisco, Sr. | A63B 69/3685 473/206 |
| 4,599,920 | A | * | 7/1986 | Schmid | B25G 1/102 16/11 |
| 5,482,270 | A | * | 1/1996 | Smith | A63B 60/12 473/203 |
| 5,588,651 | A | * | 12/1996 | Frost | B25G 1/102 2/20 |
| 5,762,563 | A | * | 6/1998 | Holzhausen | A63B 69/3632 434/252 |
| 5,788,582 | A | * | 8/1998 | Shapiro | A63B 69/3614 473/220 |
| 5,839,983 | A | | 11/1998 | Kramer | |

(Continued)

*Primary Examiner* — Nini Legesse

(74) *Attorney, Agent, or Firm* — Brian M. Kaufman; Robert D. Atkins; Atkins and Associates, P.C.

(57) ABSTRACT

A grip device is disposed on a handle of a piece of equipment. The grip device includes a lower concave surface contacting the handle and a lower concave surface oriented away from the handle. An adhesive tape is wrapped around the handle and grip device in one embodiment. In another embodiment, an adhesive layer is disposed between the handle and grip device. The lower concave surface includes a first taper at an end of the grip device oriented toward a knob of the handle. The upper convex surface includes a second taper at an end of the grip device oriented away from the knob of the handle. The grip device bends to follow a curvature of the handle.

14 Claims, 12 Drawing Sheets

(56) References Cited

U.S. PATENT DOCUMENTS

| | | | | |
|---|---|---|---|---|
| 5,867,868 | A * | 2/1999 | Ward | A63B 49/08 16/422 |
| 6,277,040 | B1 | 8/2001 | Randolph | |
| 6,705,951 | B2 * | 3/2004 | Beauregard | A63B 53/14 473/206 |
| 6,923,727 | B1 * | 8/2005 | Jacobs | A63B 69/0002 473/206 |
| 6,932,727 | B2 | 8/2005 | Kramer | |
| 7,086,973 | B2 | 8/2006 | Wells et al. | |
| 7,351,167 | B1 * | 4/2008 | Hathaway | A63B 69/0002 473/457 |
| 7,537,525 | B2 * | 5/2009 | Wang | A63B 69/3632 473/206 |
| 7,708,648 | B2 * | 5/2010 | Brunton | A63B 69/3632 473/206 |
| D650,879 | S | 12/2011 | Yoshikawa | |
| 2005/0124442 | A1 | 6/2005 | Wells et al. | |

* cited by examiner

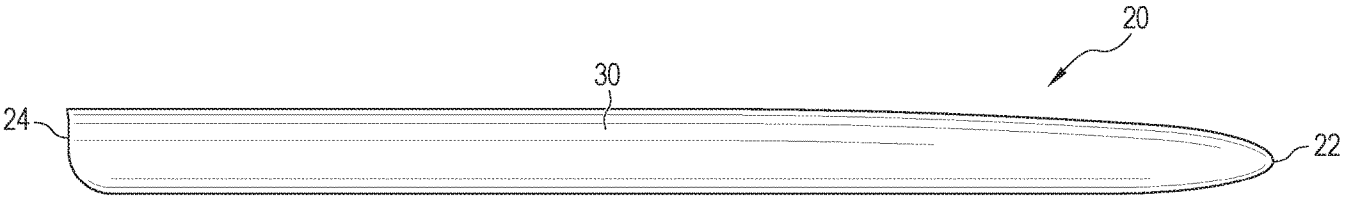
FIG. 4
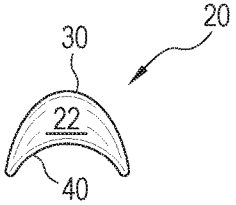
FIG. 5
FIG. 6
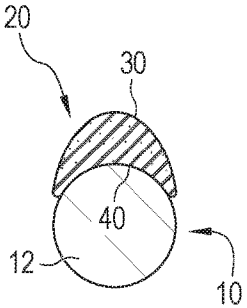
FIG. 7b
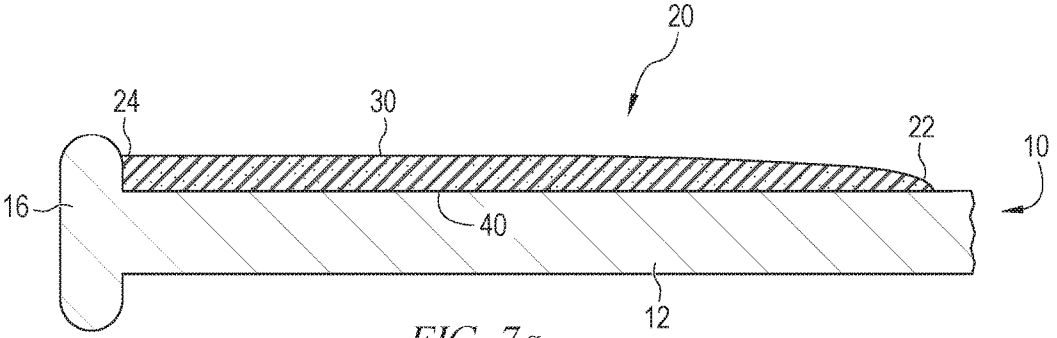
FIG. 7a

GRIP DEVICE AND METHOD FOR IMPROVING GRIP AND ALIGNING HANDS ON SPORTS EQUIPMENT

CLAIM TO DOMESTIC PRIORITY

The present application claims the benefit of U.S. Provisional Application No. 62/298,898, filed Feb. 23, 2016, which application is incorporated herein by reference.

FIELD OF THE INVENTION

The present invention relates to a grip device and, more particularly, to a system and method of aligning knuckles when gripping equipment, such as a baseball bat or softball bat.

BACKGROUND OF THE INVENTION

The game of baseball is a popular recreational and professional sport played across the world. Baseball and softball bats have had the same basic design for over a hundred years. In a traditional bat, a round barrel slims down to a round handle that has a knob on its end to keep a player's hands from sliding off the handle. The circular cross section of the handle does not provide a feature to orient the batter's hands relative to each other, or to the angular position of the bat. Correct hand positions as well as the orientation of the grain in a wooden bat have been shown to improve hitting distance, bat durability, and batter comfort.

The most common available method to maintain hand orientation and batter comfort are molded flexible grips that are roughly cylindrical in shape and are split or slit to allow installation over a bat handle. The molded flexible grips rely on friction from the interference fit with the handle to maintain position and usually incorporate finger grooved or raised sections designed to position the batter's hands relative to the grips. The grip extends essentially entirely around the baseball bat handle, so that the larger cross section and the finger notches have a significant impact on how the bat feels. Installing prior art bat grips creates a jarring transition from use of the grip to use of a bare bat handle, which is problematic for times when the grips are not available or for leagues that do not allow aftermarket grips on bats.

A second available method to maintain hand orientation and batter comfort is called a V-grip bat as described in U.S. Pat. No. 7,086,973. The V-grip bat incorporates a handle cross section that has two flattened sections or a rounded triangular shaped cross section. The V-grip bat design helps orient the batter's hands relative to each other and the bat. However, since the feature is integrated into the bat, adjusting for a particular batter's preferences and/or growth is problematic without buying another entire bat. The V-grip bat can be expensive and limits the batter's options to the particular V-grip bat that is purchased. Since the V-grip feature is part of the bat substrate material, the feature does not provide significant vibration damping.

BRIEF DESCRIPTION OF THE DRAWINGS

FIG. 4 illustrates a side view of the grip device;
FIG. 5 illustrates a back view of the grip device;
FIG. 6 illustrates a front view of the grip device;

FIGS. 7*a*-7*b* illustrate cross-sectional views of the grip device on a baseball bat.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
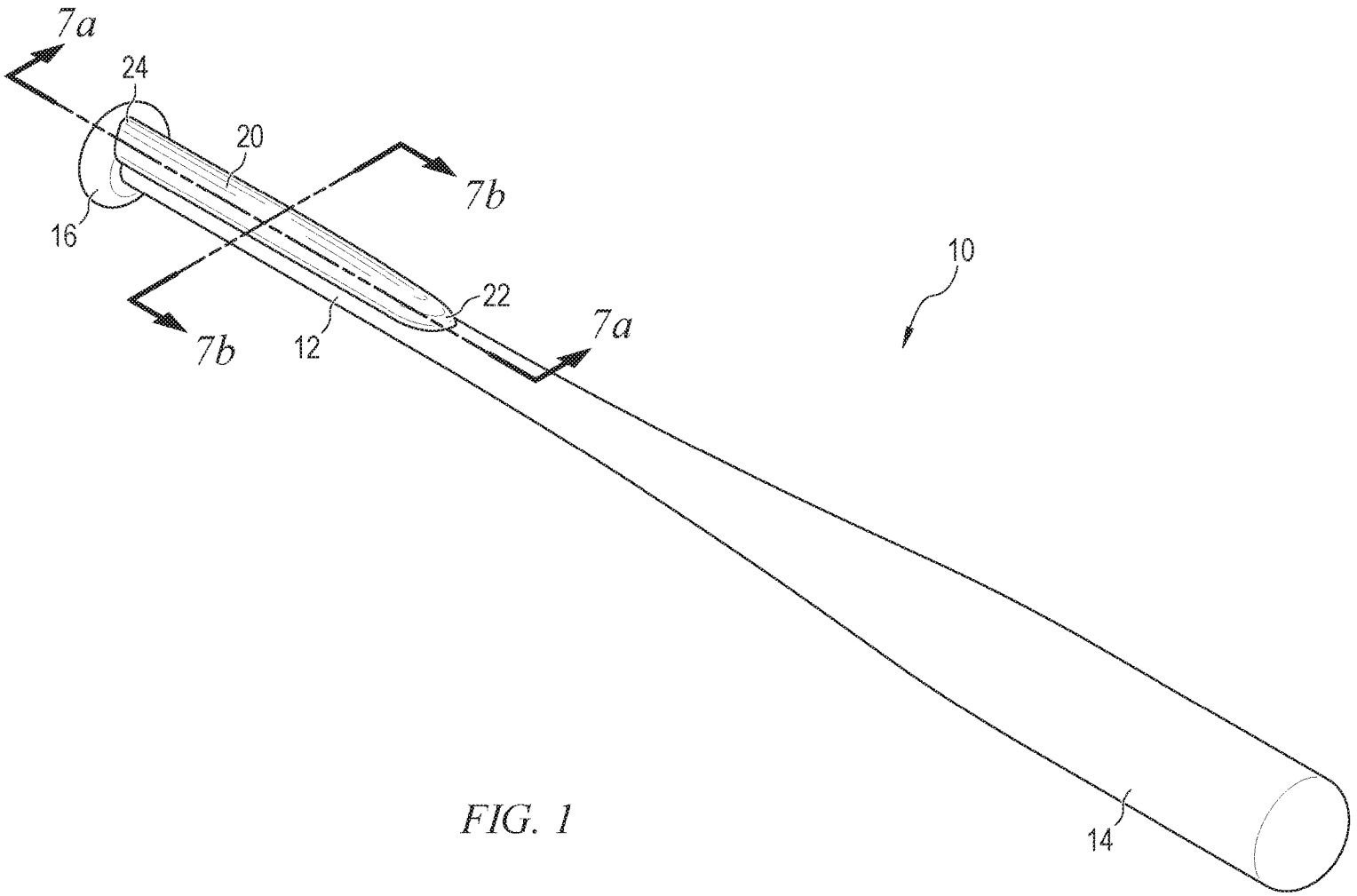
FIG. 1 illustrates a baseball bat with a grip device.

FIG. 1 illustrates a baseball bat 10 having handle 12 and barrel 14. A knob 16 on handle 12 helps keep a user's hands from sliding off the end of the handle when bat 10 is swung. A grip device 20 is positioned on handle 12 of bat 10. Grip device 20 is designed to be positioned parallel to the axis of bat 10 running from knob 16 to barrel 14. Grip device 20 is designed to be installed on any style baseball or softball bat without compromising the integrity of the bat itself. Grip device 20 includes a first end 22 oriented toward barrel 14 and a second end 24 oriented toward knob 16.

Figure 2:
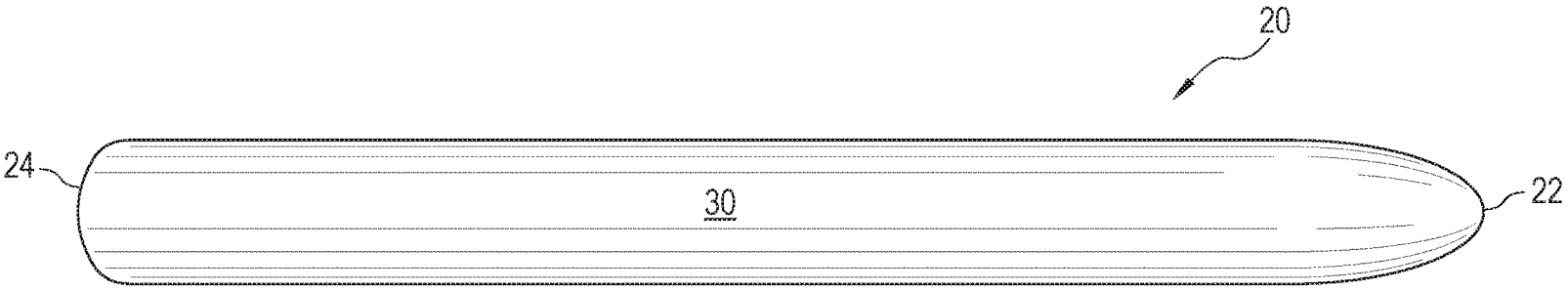
FIG. 2 illustrates a top view of the grip device.

FIG. 2 shows a top view of grip device 20, i.e., the side of the grip device oriented away from handle 12 when installed on bat 10, including an upper convex surface 30. A user holding bat 10 with grip device 20 installed presses inner surfaces of the user's knuckles against upper surface 30. The curvature of upper convex surface 30 of grip device 20 is similar to the curvature of handle 12, so that grip device 20 feels natural to hold and swing to a user who is comfortable swinging bat 10 without grip device 20. Upper surface 30 of grip device 20 has a 'U' shape that naturally positions under the first knuckles of both hands and conforms to the natural curvature a user experiences when holding baseball bat 10 without grip device 20. Similarity between upper convex surface 30 and a bare handle 12, combined with the ability to remove and replace grip device 20, provides a smooth and easy transition between use of bat 10 with grip device 20 and use of the bat without the grip device.

Figure 3:
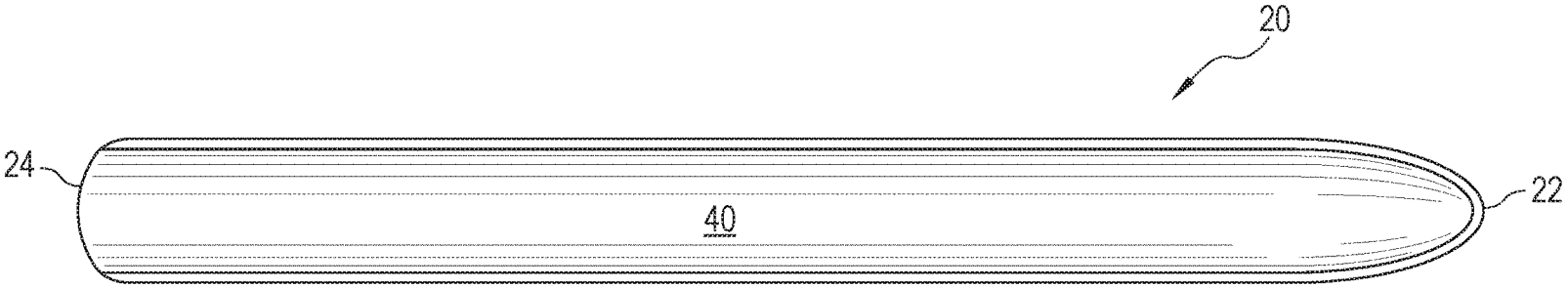
FIG. 3 illustrates a bottom view of the grip device.

FIG. 3 shows a bottom view of grip device 20, i.e., the side of the grip device that is in contact with handle 12 when installed on bat 10, including a lower concave surface 40. Lower concave surface 40 is approximately cylindrical, having an arc radius approximately equal to the radius of a baseball bat handle. In one embodiment, grip device 20 is used with a baseball bat handle diameter of between ¾ inch and 5/4 inch, so the arc radius of lower concave surface 40 is between ⅜ inch and ⅝ inch. A grip device 20 can be manufactured with an inner radius configured to match any bat 10 that the grip device is to be used with. The range of handle 12 diameters that a specific grip device 20 will fit can be increased by forming the grip device from a flexible material such as polyurethane. The grip device 20 can be stretched over handles 12 that have a larger radius than the arc radius of lower concave surface 40, or held onto a handle 12 with a lower radius than lower concave surface 40.

FIG. 4 shows a side view of grip device 20, with upper convex surface 30 oriented up on the page. Lower concave surface 40 is oriented down on the page, but hidden from view by upper convex surface 30. In some embodiments, knob-end 24 of grip device 20 curves out toward upper convex surface 30 to approximate the curvature of knob 16.

FIGS. 5 and 6 show head-on views of knob-end 24 and barrel-end 22, respectively. FIGS. 5 and 6 illustrate upper convex surface 30 and lower concave surface 40 in cross section. An arc length of lower concave surface 40 around handle 12 is less than 180 degrees in one embodiment. An arc length of less than 180 degrees for lower concave surface 40 allows a user's hands to contact handle 12 of bat 10 for a majority of the handle's circumference. The significant contact between a user's hands and handle 12 adds to the natural feel of swinging bat 10 with grip device 20 installed. Upper convex surface 30 has a larger surface area than lower concave surface 40 to allow for space between the upper and lower surfaces. Upper convex surface 30 includes a generally rounded shape, and can be parabolic, hyperbolic, elliptical, oval, oblong, or can have a more irregular curvature. In other embodiments, upper convex surface 30 includes a pointed or any other desired shape.

FIGS. 7*a*-7*b* illustrate cross-sectional views of grip device 20 on baseball bat 10. FIG. 7*a* illustrates a cross section through the long axis of bat 10, i.e., the axis extending through knob 16 and barrel 14. FIG. 7*b* illustrates a cross section perpendicular to the view of FIG. 7*a*, through handle 12. In FIG. 7*a*, lower concave surface 40 is shown lying against handle 12 for the length of grip device 20. Barrel-end 22 of grip device 20 thins toward barrel 14 of bat 10. Knob-end 24 of grip device 20 contacts or abuts knob 16, and optionally curves toward knob 16 further away from handle 12 so that the grip device stays in contact with knob 16 across the entire width of the grip device from lower concave surface 40 to upper convex surface 30. Knob-end 24 generally butts up against and is flush with knob 16.

Grip device 20 extends for a length from knob 16 toward barrel 14. Grip device 20 can extend for any appropriate length. In one embodiment, the length of grip device 20 is between three inches and twelve inches. Shorter grip devices that only accommodate a single hand of a user may be used to provide tactile feedback of the angle a user is holding the bat at, even if a second hand of the user does not contact the grip device during use for tactile feedback of knuckle alignment.

In FIG. 7*b*, the arc length of lower concave surface 40 can be seen relative to the circular cross section of handle 12. Grip device 20 covers less than 180 degrees of the handle 12 cross section, so a user's hands make significant contact with handle 12 when holding baseball bat 10. Grip device 20 creates a tactile bump on handle 12 that extends parallel to the length of bat 10. Grip device 20 allows a user to align the knuckles of his or her left hand with the knuckles of the right hand using the tactile sensation of the bump.

When holding bat 10 having grip device 20 installed, and with the user's knuckles properly aligned, the grip device will have a similar feeling in each of the user's hands. Upper convex surface 30 presses on approximately the same point in both hands when a user has a proper grip on bat 10. Without grip device 20, handle 12 is a circle and feels essentially the same within both hands no matter how bat 10 is gripped.

Figure 8A:
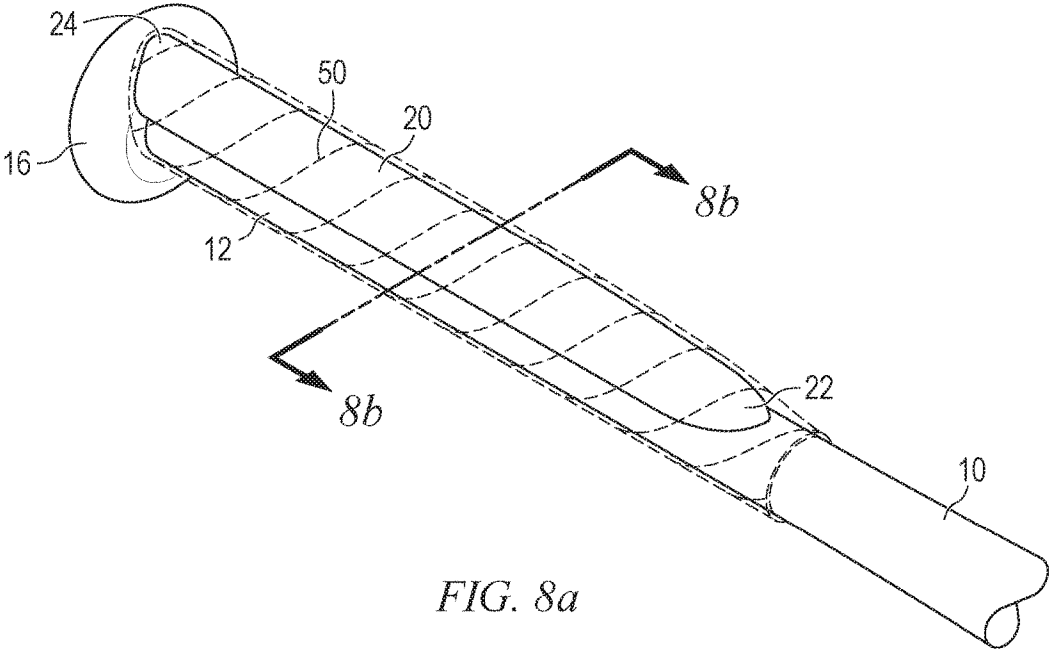
FIGS. 8*a*-8*c* illustrate the grip device installed on a baseball bat using traditional grip tape or an adhesive.

FIG. 8*a* illustrates grip device 20 held onto handle 12 by grip tape 50. Grip tape 50 may be traditional bat grip tape, cloth athletic tape, or any other appropriate type of adhesive tape. Grip device 20 is placed onto handle 12, and then tape 50 is wrapped around the combination of the grip device and handle. The roll of tape is moved from knob-end 24 to barrel-end 22, or vice versa, while wrapping to completely cover grip device 20. In some embodiments, a distance of handle 12 past grip device 20 is wrapped in tape. In other embodiments, grip device 20 is only partially covered in by grip tape 50.

Grip tape 50 includes adhesive on the side of the grip tape oriented toward bat 10 and grip device 20, and sticks securely to the bat and grip device. In some embodiments, grip tape 50 includes a texture on the side of the grip tape oriented away from bat 10 designed to improve traction between a user's hands and handle 12. Grip device 20 is securely attached to bat 10 by grip tape 50. A user can set bat 10 down, or store bat 10 between games, and grip tape 50 keeps grip device 20 in the same general position on the bat for subsequent uses.

Figure 8C:
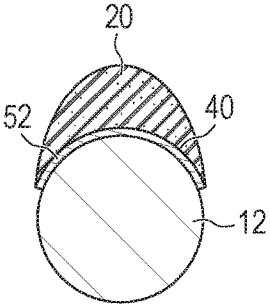
Figure 8B:
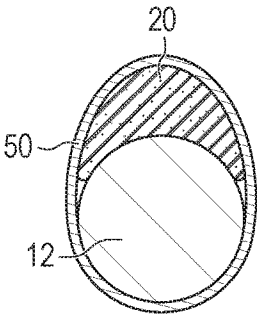

FIG. 8*b* illustrates a cross section of bat 10 through handle 12 with grip device 20 installed and wrapped in grip tape 50 to hold the grip device on the handle. FIG. 8*c* illustrates another embodiment with grip device 20 held onto handle 12 by an adhesive layer 52 disposed on lower concave surface 40. Lower concave surface 40 has an adhesive layer applied during manufacture of grip device 20. In some embodiments, adhesive layer 52 is covered in a paper or other protective material to protect the adhesive during transport and sale of grip device 20. An end user removes the paper covering to expose adhesive 52 prior to installing grip device 20 onto handle 12. Adhesive 52 sticks between handle 12 and grip device 20 to keep the grip device 20 in place between uses of bat 10.

In some embodiments, grip device 20 is sold without adhesive 52, and a user applies an adhesive to grip device 20 or handle 12 prior to sticking the grip device on the handle. In other embodiments, grip device 20 is used without adhesive 52 or tape 50, and held onto bat 10 simply by a user's grip. Grip device 20 may be formed from a polymer with sticky or suction properties to aid in keeping the grip device in place on bat 10 during use without a separate adhesive 52 or tape 50.

Figure 9:
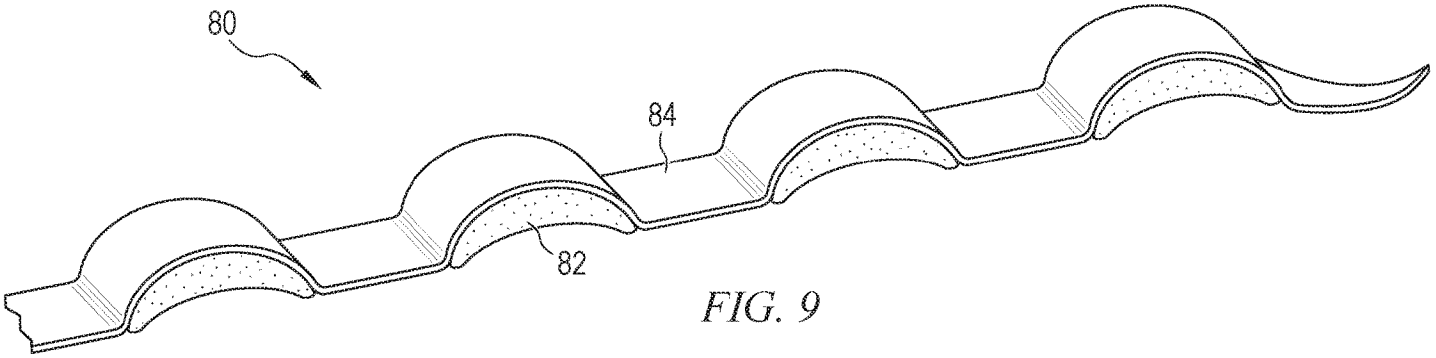
FIGS. 9-11 illustrate an embodiment having the grip device integrated with grip tape.
Figure 10:
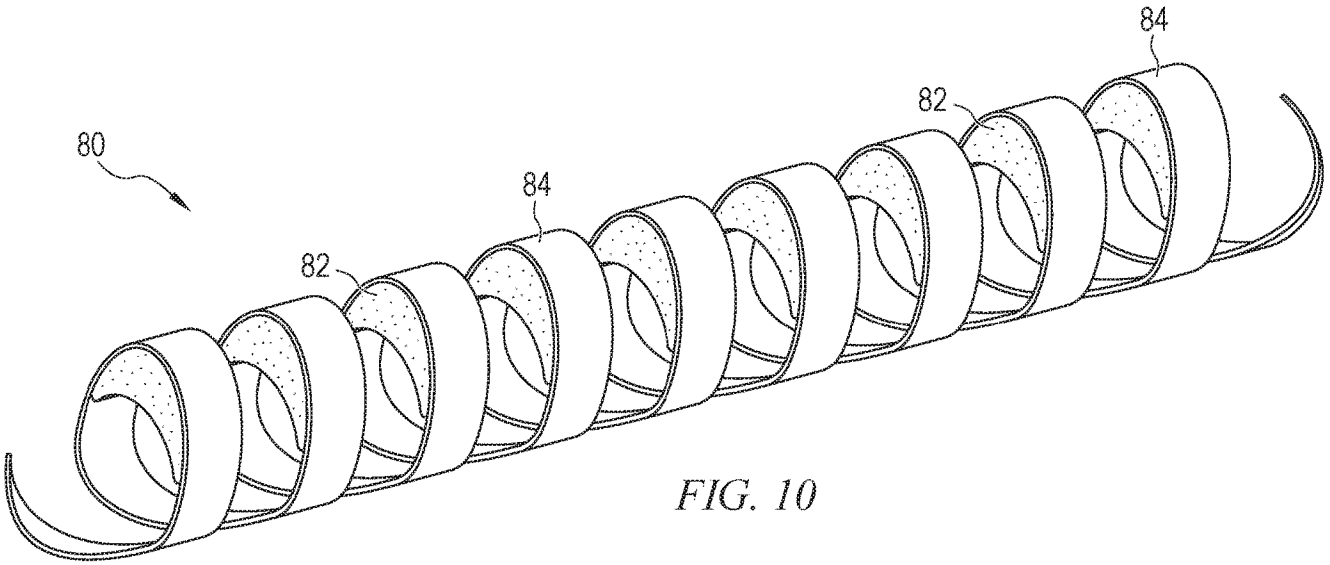
Figure 11:
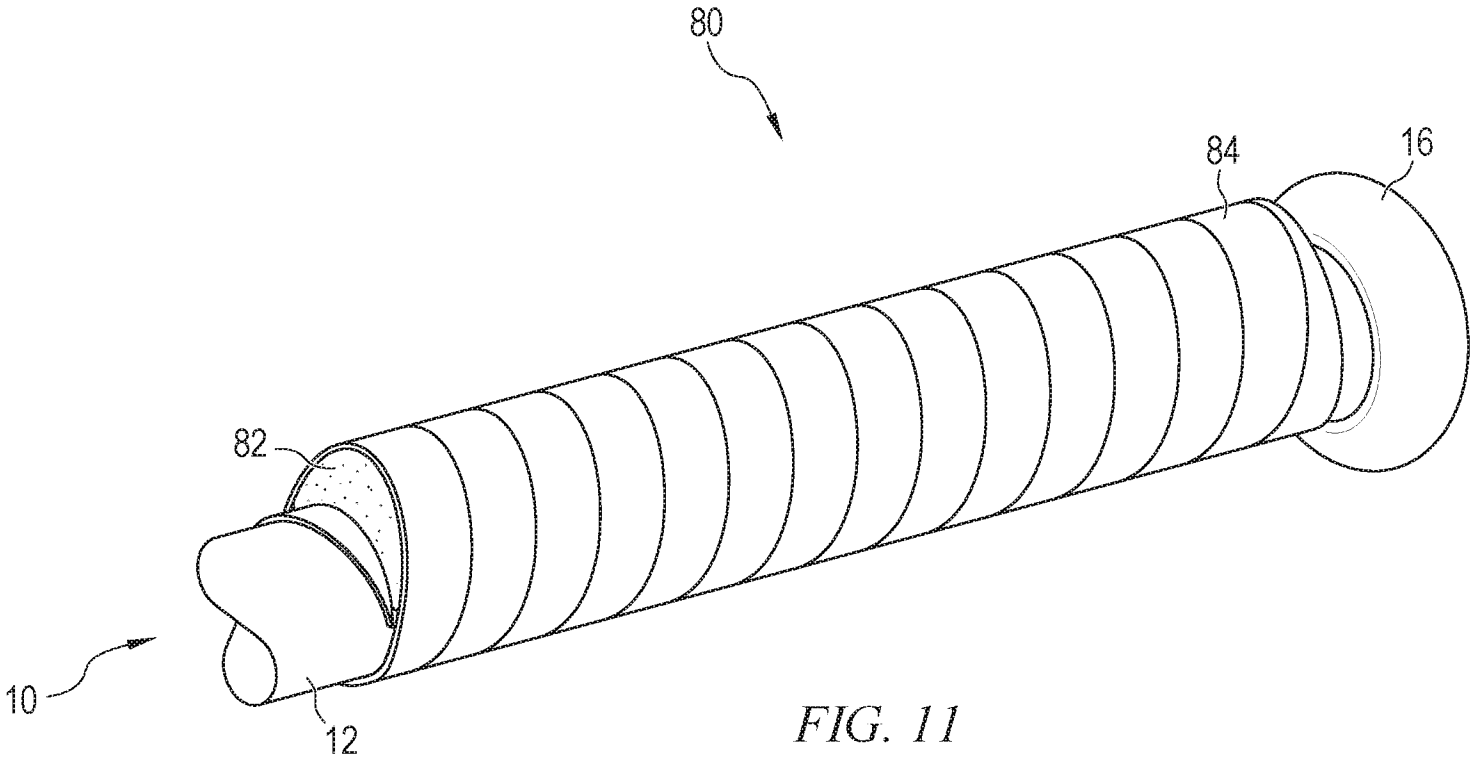

FIGS. 9-11 show an alternate embodiment with grip device 80 provided as segments 82 separately attached to grip tape 84. FIG. 9 shows grip tape 84 stretched out with segments 82 separated by a length of the grip tape. The distance between the centers of two adjacent segments 82 corresponds to the circumference of handle 12 so that the segments are aligned when tape 84 is wrapped around the handle. FIG. 10 shows grip tape 84 curled similar to how grip device 80 would be oriented when installed on a bat 10, but with lateral separation between segments 82 that would not normally exist when installed.

FIG. 11 shows grip device 80 with grip tape 84 wound around handle 12. Once installed onto bat 10, grip device 80 has similar design and features as described above for grip device 20. The grip device 80 is wrapped around the desired item and the user does not have to put any other item on to help adhere the built-in grip device tape to the desired item. Segments 82 can be formed in any of the shapes discussed below as desired for an individual user or use.

Figure 12:
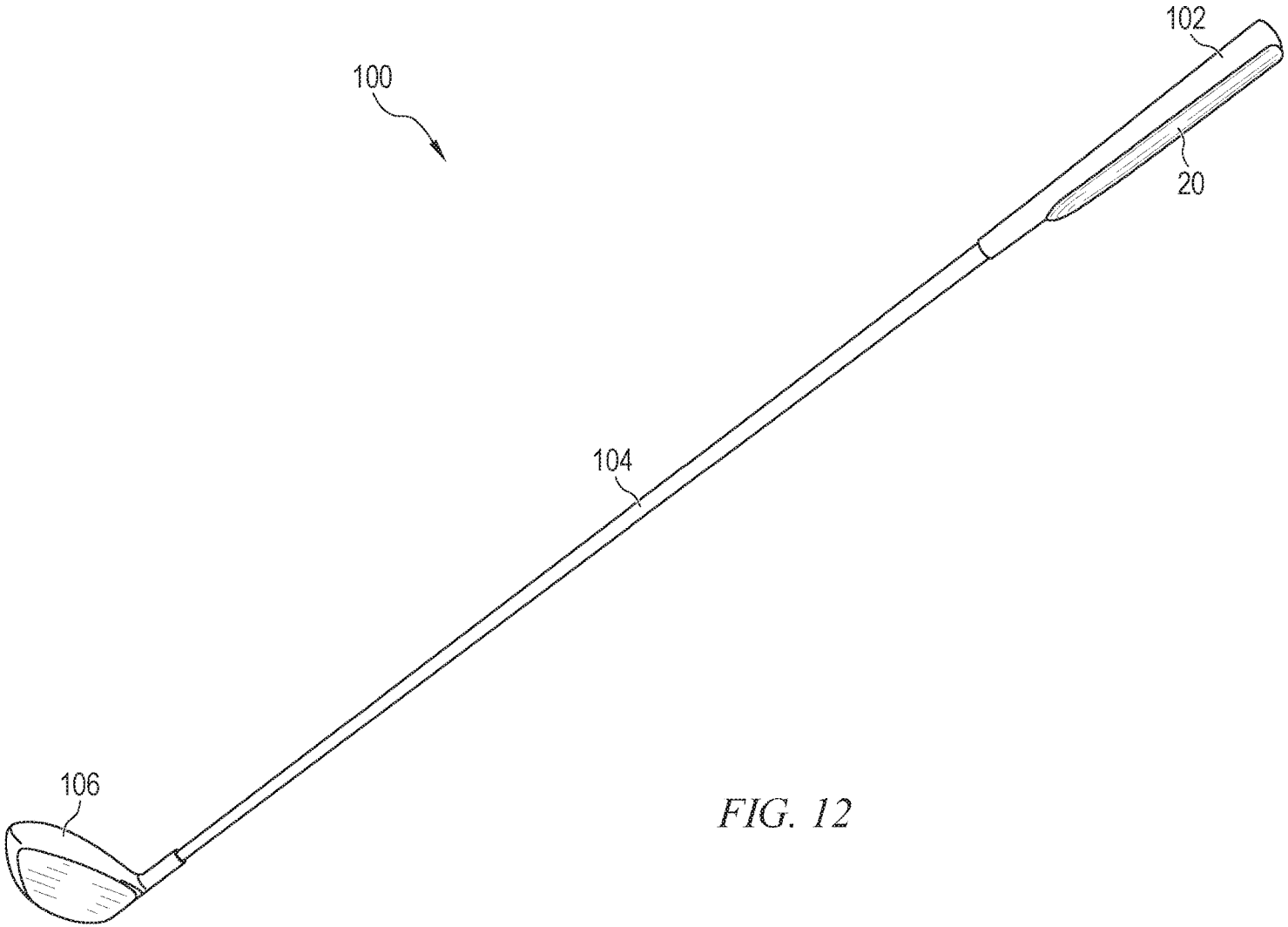
FIG. 12 illustrates the grip device installed on a golf club.

FIG. 12 shows a golf club 100 with grip device 20 installed. Golf club 100 includes handle 102, shaft 104, and head 106. A user grips handle 102 and uses grip device 20 to align his or her knuckles. The user swings golf club 100 to hit a golf ball with head 106. Having a proper grip on handle 102, thanks to grip device 20, helps improve the form and strength that a user is able to hit a golf ball with, and potentially increases the distance that a ball travels when hit. In other embodiment, grip device 20 is used with any handle application, such as hockey sticks, broom handles, lawn mowers, weed whackers, power tools, hand held tools, fishing poles, weight lifting bars, handle bars, or tennis rackets.

Figure 13:
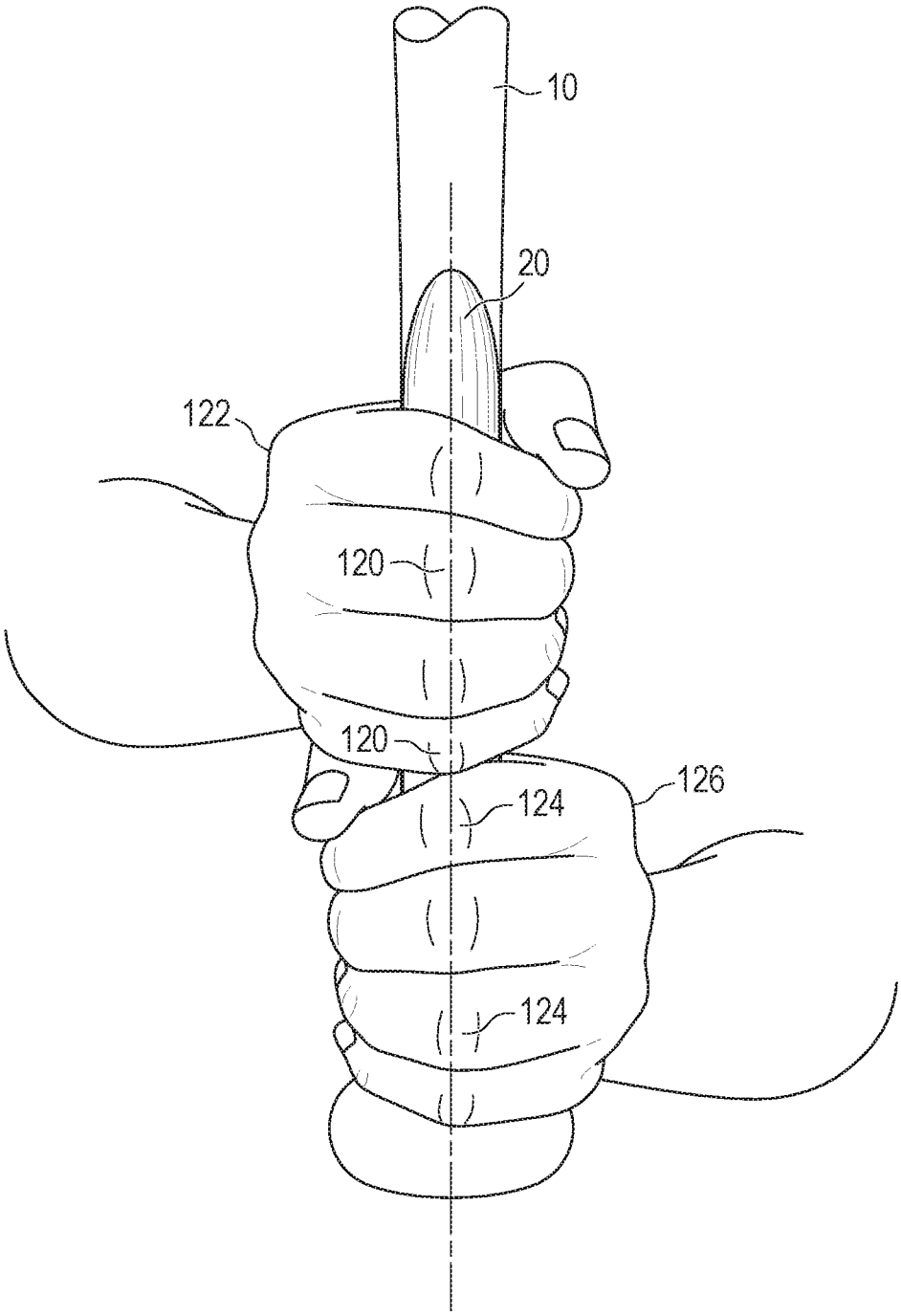
FIG. 13 illustrates one proper knuckle alignment using the grip device on a baseball bat.

FIG. 13 shows a user holding baseball bat 10 with grip device 20 to demonstrate a proper knuckle alignment. Grip device 20 for baseball and softball purposes helps align or line up the user's hands and knuckles to each other and to the wood grain of wooden bats. FIG. 13 shows a user holding bat 10 with first knuckles 120 of right hand 122 aligned to first knuckles 124 of left hand 126. The user picks up bat 10 and grips handle 12 and grip device 20 together. Grip device 20 provides a bump on handle 12 that sets similarly under knuckles 120 and 124 to give the user a tactile affirmation of proper knuckle alignment.

In other cases, the desired knuckles to be aligned may be the second knuckles of each hand, or a user may desire to align the first knuckles of one hand with the second knuckles of the other hand. In any case, the user picks up bat 10 and uses the tactile feeling of grip device 20 under the desired alignment point to ensure the desired grip on handle 12. Specific alignment criteria depend on the user's preference. The correct hand position and alignment will give more power and a more consistent swing. Grip device 20 also reduces bat sting, which can be caused by the ball hitting the bat and vibrating a user's hands. Grip device 20 reduces bat sting both by encouraging proper alignment of the hands, and by a dampening effect of the material the grip device is made of.

Grip device 20 is generally of solid construction with relatively smooth surfaces 30 and 40. In other embodiments, grip device 20 is hollow to reduce weight or manufacturing cost. A hollow grip device 20 may have internal support structures to keep a user's grip from crushing the grip device. In some embodiments, upper convex surface 30 has ribs or other grip features that can be felt through grip tape 50. The grip features on upper convex surface 30 increase friction between grip device 20 and a user's hand, and thus handle 12 and the grip device as a whole, especially with thin tape that does not otherwise provide significant added grip to handle 12.

Grip device 20 is made from a variety of materials in different embodiments. In one embodiment, grip device 20 is injection molded using a relatively stiff rubber that is durable. In other embodiments, grip device 20 includes another appropriate material such as wood, plastic, metal, foam, or clay. Grip device 20 can be molded, 3D-printed, machined, or formed using another appropriate manufacturing process.

Grip device 20 increases the amount of pressure with which the bat or other equipment may be comfortably held or swung due to the fingers being more extended than when holding a handle without the grip device. Grip device 20 provides a more natural and comfortable grip for the user while providing a tactile bump for aligning the knuckles.

Figure 14C:
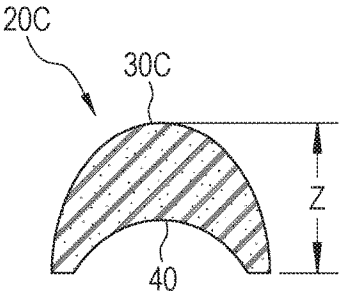
FIGS. 14*a*-14*c* illustrate the grip device manufactured with varying thicknesses.
Figure 14B:
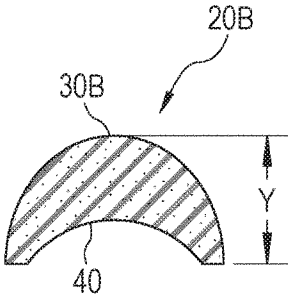
Figure 14A:
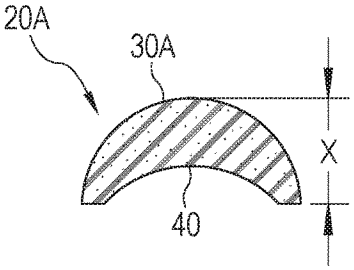

FIGS. 14*a*-14*c* illustrate cross sections of grip devices 20*a*-20*c* with three different thicknesses. In baseball, there are many types of players that have many different hand sizes. Accordingly, different players with different sized hands may require different thickness of grip device 20. FIG. 14*a* shows grip device 20*a* in a Small or Youth size. Lower concave surface 40 includes essentially the same shape as with grip device 20 above, but grip device 20*a* includes an upper convex surface 30*a* that is closer to the lower concave surface to reduce an overall thickness X of the grip device. FIG. 14*b* shows a medium or youth/adult size grip device 20*b* with thickness Y, and FIG. 14*c* shows a large or adult size grip device 20*c* with thickness Z. In one case, grip device 20*a* is manufactured with a total thickness X from the bottom of surface 30*a* to the peak of the curve of surface 30*a* that is 0.5 inches, while grip device 20*b* has a total thickness Y of 0.6 inches and grip device 20*b* includes a total thickness Z of 0.7 inches. Grip device 20 can be manufactured with any total thickness as desired for a particular use and user. In one embodiment, a thickness of grip device 20 is between an eighth inch and one inch.

Figure 15C:
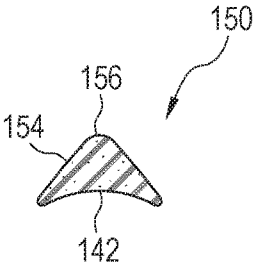
FIGS. 15*a*-15*c* illustrate additional embodiments of the grip device.
Figure 15B:
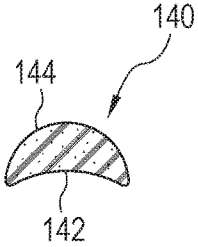
Figure 15A:
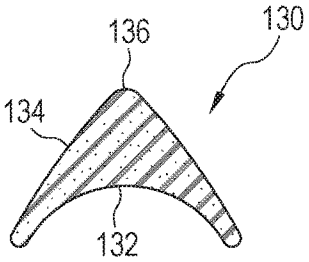

FIGS. 15*a*-15*c* illustrate alternative cross-sectional shapes for grip devices. Grip devices generally have a lower concave surface that has a similar arc radius to the radius of a baseball bat, or any other piece of equipment, being used with the grip device. The lower concave surface in some embodiments may not be cylindrical if the handle for use with the particular grip device does not have a circular cross section. The grip devices may be manufactured with a variety of arc radii to have different grip device models that work with different handle thicknesses. FIG. 15*a* shows grip device 130 having lower concave surface 132, which is similar to lower surface 40 of grip device 20. Grip device 130 includes an upper surface 134 having a point or peak 136. Point 136 extends the length of grip device 20 in some embodiments, and provides a significantly more noticeable tactile feeling to a user holding bat 10 with grip device 130 installed. Point 136 presses into a user's hands with a more noticeable sensation than upper convex surface 30, which is designed to approximate the curvature of the underlying handle 12. Point 136 provides increased tactile enforcement to remind a user to align his or her hands on the baseball bat. Grip device 130 with point 136 can be formed with varying thickness as shown in FIGS. 14*a*-14*c*.

FIG. 15*b* illustrates a grip device 140 having a lower concave surface 142. Lower concave surface 142 includes an arc radius approximately equal to the arc radius of lower concave surface 40 to lie in contact with the same handle 12 as grip device 20. However, the arc length of lower concave surface 142 is substantially less than the arc length of lower concave surface 40. Grip device 140 covers up less of handle 12 than grip device 20. The arc length of lower concave surface 142, and thus the width of grip device 140, can be made larger or smaller as desired to customize the fit and feel of a grip device. A lower width grip device 140 can help the grip device be less intrusive when in use.

A grip device can be made with any width appropriate for a handle the grip device is being used with. In one embodiment, a grip device width is between a quarter inch and one inch. The width of a grip device, generally proportional to the arc-length of the lower concave surface, can be customized independently of the grip device thickness to accommodate the preferences of a user. Grip device 140 in FIG. 15*b*, with the reduced width, can still be manufactured with the three different thicknesses of FIGS. 14*a*-14*c*, or any other appropriate thickness.

FIG. 15*c* shows a grip device 150 having a shorter width like grip device 140, in combination with an upper surface 154 having point 156, similar to grip device 130. Grip device 150 combines a lower intrusiveness that comes with lower thickness with the enhanced tactile sensation provided by point 156.

FIG. 16*a*-16*d* illustrate grip device 160 with upper convex surface 162 having a taper 164. Grip device 160 is manufactured by injection molding, compression molding, 3D printing, or another appropriate manufacturing process using acrylonitrile butadiene styrene (ABS), natural rubber, or another appropriate material. In some embodiments, grip device 160 is flexible to better conform to the circumference of a handle, as well as the curvature of a bat expanding outwards from the knob to the barrel that may occur within the length of the grip device. In other embodiments, grip device 160 is rigid and may be customized for the specific geometry of a given bat. Grip device 160 can be formed with varying thicknesses, widths, and cross-sectional shapes as described above.

Figure 16A:
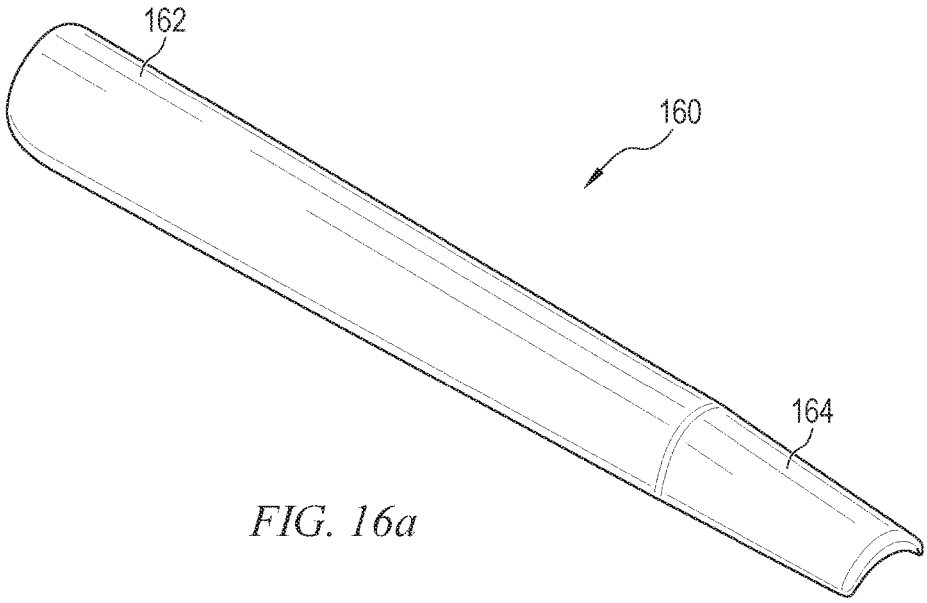
FIGS. 16*a*-16*d* illustrate a grip device with an internal taper.

FIG. 16*a* shows upper convex surface 162 of grip device 160, similar to upper convex surface 30, and having a tapered section 164. Upper convex surface 162 may include a slight taper along the entire length of grip device 160, or may lie parallel to the handle when in use other than tapered portion 164. Taper 164 is optional and helps smooth the transition from grip device 160 to baseball bat 10 along the length of the bat. In some embodiments, grip device 160 does not taper at all, and is a uniform thickness for the entire length of the grip device. In another embodiment, grip device 160 is thinner toward knob 16 and thicker toward barrel 14.

Figure 16B:
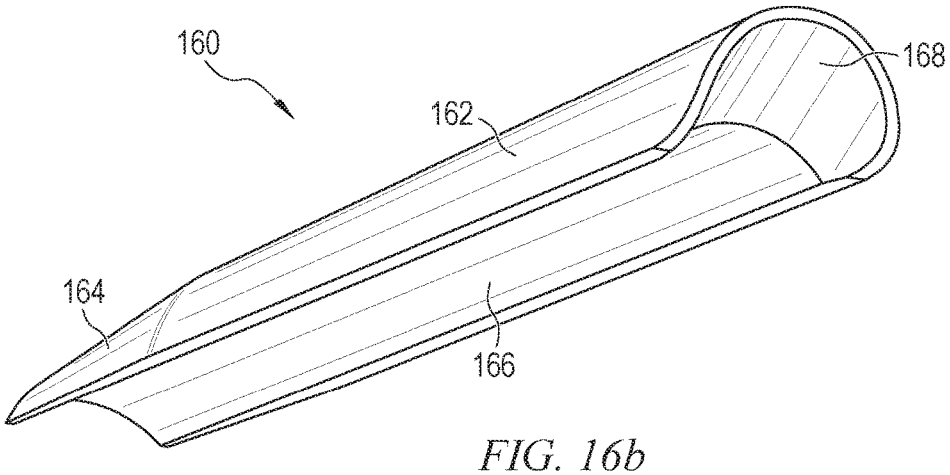

FIG. 16*b* shows lower concave surface 166 of grip device 160. Lower concave surface 166 includes a taper 168. Taper 168 is oriented toward knob 16 when grip device 160 is in use. Taper 168 accommodates weld fillets 169, as shown in FIG. 16*d*, which are commonly found at the interface between handle 12 and knob 16. Taper 168 allows grip device 160 to contact knob 16 in embodiments where a weld fillet or other structure adjacent to the knob would otherwise displace the grip device.

Figure 16C:
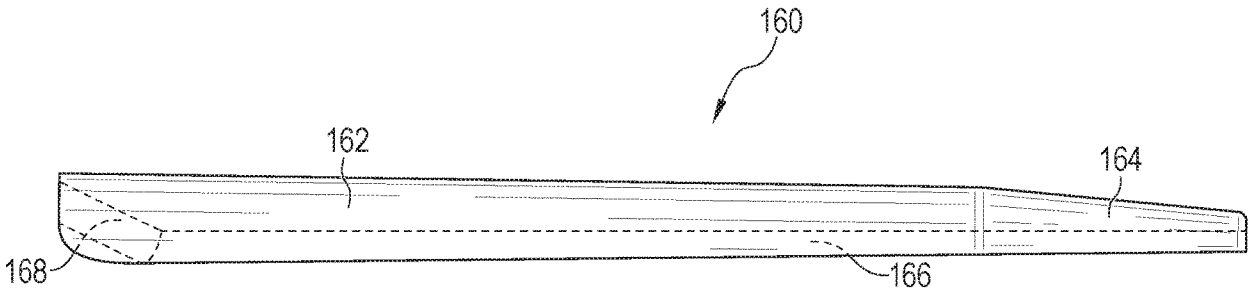
Figure 16D:
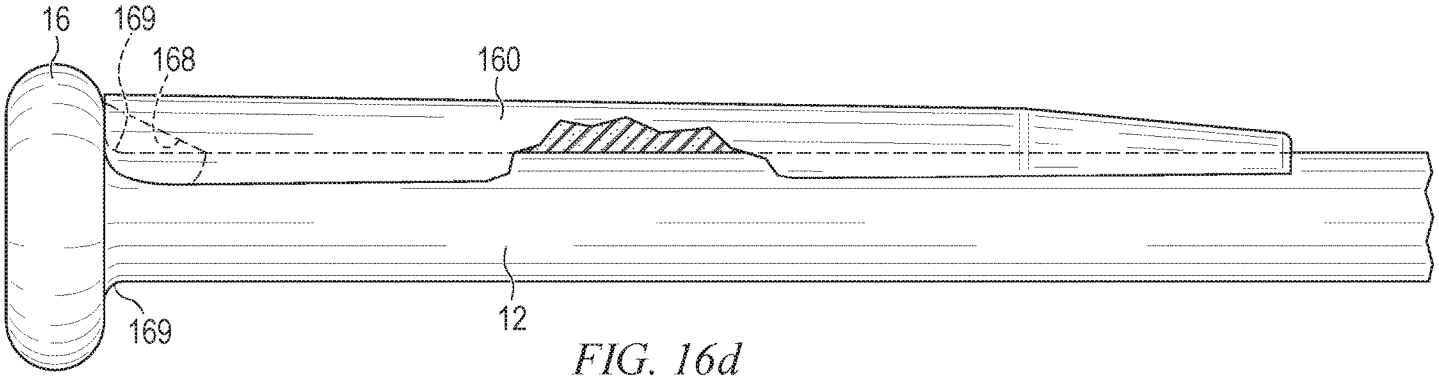

FIG. 16*c* illustrates a side view of grip device 160 better illustrating the taper 164. Lower concave surface 166 including taper 168 is illustrated as a dotted line. FIG. 16*d* illustrates grip device 160 on bat 10. Bat 10 includes a weld fillet 169 that holds knob 16 onto handle 12. Fillet 169 fits within the space created by taper 168. Fillet 169 is generally a circle around the entire interface between handle 12 and knob 16. Taper 168 is three dimensional to create clearance for fillet 169 along the entire arc length of lower concave surface 166. Grip device 160 abuts knob 16. Without taper 168, fillet 169 would contact a corner of grip device 160 and potentially create a separation between the grip device and knob 16. Grip device 160 operates properly with separation from knob 16. However, a user's hand generally rests against knob 16 while swinging bat 10, so having a grip device that abuts knob 16 increases comfort by not having a significant gap that the user feels.

Figure 17A:
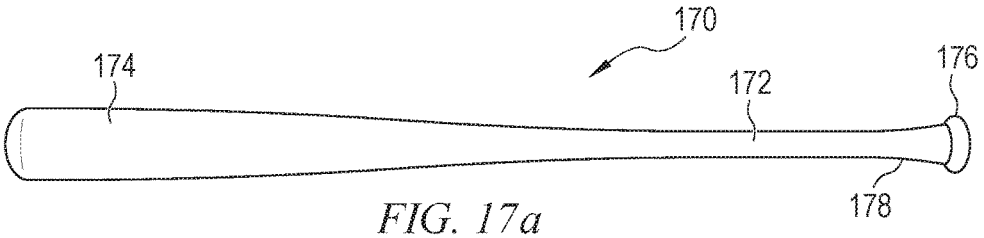
FIGS. 17*a*-17*d* illustrate a grip device with a taper on two ends.

FIG. 17*a* illustrates a wooden baseball bat 170. Bat 170 includes handle 172, barrel 174, and knob 176, similar to bat 10. Handle 172 includes an expanded region 178 toward knob 176. The expansion of handle 172 toward knob 176 increases the connection strength of the knob to the handle, but creates a different geometry than what is normal for metal bats. The specific geometry of wooden baseball bats can be accounted for by having a taper at the knob-end of a grip device.

Figure 17B:
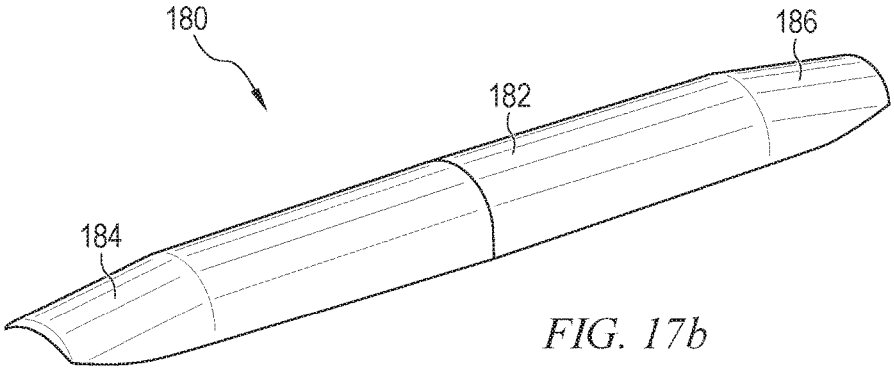
Figure 17C:
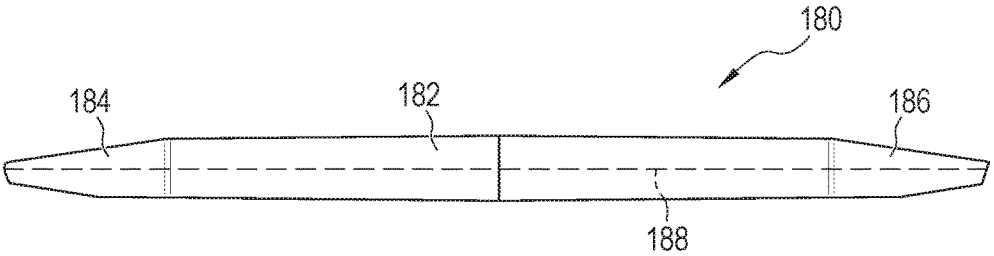

FIG. 17*b* illustrates a grip device 180 having a top convex surface 182 with both a barrel-end taper 184 and a knob-end taper 186. FIG. 17*c* illustrates the top of lower concave surface 188 as a dotted line.

Figure 17D:
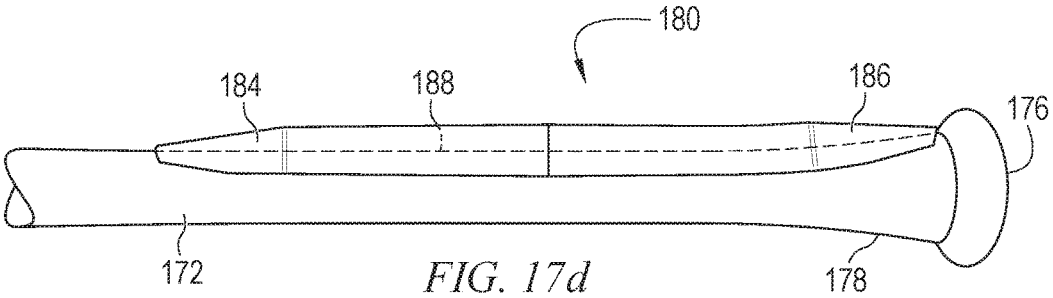

FIG. 17*d* illustrates grip device 180 installed on handle 172 of wood bat 170. Grip device 180 is flexible or bends to conform to expanded region 178 of handle 172. Taper 186 causes grip device 180 to thin toward knob 176 so that the grip device does not extend outside the thickness of knob 176. Knob 176 can still be contacted by a user's hand while using bat 170 with grip device 180.

Using a grip device, e.g., grip device 20, 80, 130, 140, 150, 160, or 180, with a baseball bat or other equipment helps a user align his or her hands for a proper grip that improves strength of the user gripping, swinging, or otherwise handling the equipment. A grip device increases friction of the baseball bat against a user's hands, which helps reduce the likelihood that the bat will rotate within the user's hands during use. The grip device gives tactile feedback of the angle of the bat within a user's hands without a user having to visually verify that the bat is being held at the proper rotational angle. A grip device that is removable increases the usefulness of the grip device by allowing the grip device to be used with larger bats as a user grows. The removable nature also allows the grip device to be removed if needed for certain league games. The grip device does not harm the integrity of a bat, so a bat retains its value after removal of the grip device.

While one or more embodiments of the present invention have been illustrated in detail, the skilled artisan will appreciate that modifications and adaptations to those embodiments may be made without departing from the scope of the present invention as set forth in the following claims.

What is claimed is:

1. A piece of equipment, comprising:
a handle; and
a grip device disposed on the handle and including,
a lower concave surface contacting the handle, wherein the lower concave surface includes a taper that reduces a thickness of the grip device at an end of the grip device oriented toward a knob of the handle, and
an upper convex surface oriented away from the handle with the lower concave surface meeting the upper convex surface along an entire length of the grip device, wherein the upper convex surface includes a curvature across the handle that has a substantially uniform shape along the entire length of the grip device.

2. The equipment of claim 1, further including an adhesive tape wrapped around the handle and grip device.

3. The equipment of claim 1, wherein the upper convex surface includes a taper that reduces a thickness of the grip device at an end of the grip device oriented away from a knob of the handle.

4. The equipment of claim 1, wherein the grip device is significantly flexible to allow the grip device to be used on a plurality of handles with different sizes.

5. A grip device, comprising:
an upper convex surface including a first taper that reduces a thickness of the grip device toward a first end of the grip device; and
a lower concave surface including a second taper that reduces the thickness of the grip device toward a second end of the grip device, wherein a cross-section of the grip device includes a substantially uniform shape along an entire length of the grip device between the first taper and second taper, and wherein the length of the grip device is significantly greater than a width and thickness of the grip device.

6. The grip device of claim 5, wherein the upper convex surface includes a "U" shape along the entire length of the grip device.

7. The grip device of claim 5, wherein the upper convex surface includes a point along the entire length of the grip device.

8. The grip device of claim 5, wherein the grip device includes a substantially flexible material.

9. The grip device of claim 5, further including an adhesive layer disposed on the lower concave surface.

10. The grip device of claim 5, further including a baseball or softball bat contacting the lower concave surface.

11. A grip device, comprising:

an upper convex surface including a single tactile bump that extends parallel to a length of the grip device for an entirety of the length of the grip device, wherein the upper convex surface includes a first taper that reduces a thickness of the grip device at the first end of the length of the grip device; and a lower concave surface including a cylindrical shape extending along the length of the grip device, wherein an arc length of the lower concave surface is less than 180 degrees.

12. The grip device of claim 11, further including an adhesive layer disposed on the lower concave surface.

13. The grip device of claim 11, wherein the upper convex surface includes a ridge extending for a substantial entirety of the length of the grip device.

14. The grip device of claim 11, wherein the upper convex surface includes a second taper that reduces the thickness of the grip device at a second end of the grip device opposite the first end.

* * * * *